US006553751B2

(12) United States Patent
Weinberg

(10) Patent No.: US 6,553,751 B2
(45) Date of Patent: Apr. 29, 2003

(54) EXTERIOR SHAPED LINK AND METHOD

(76) Inventor: Eitan Weinberg, 16-16 Split Rock Rd., Fairlawn, NJ (US) 07410

( * ) Notice: Subject to any disclaimer, the term of this patent is extended or adjusted under 35 U.S.C. 154(b) by 0 days.

(21) Appl. No.: 09/779,774

(22) Filed: Feb. 8, 2001

(65) Prior Publication Data

US 2002/0104306 A1 Aug. 8, 2002

(51) Int. Cl.[7] ..... B21L 17/00
(52) U.S. Cl. ..... 59/35.1; 59/80
(58) Field of Search ..... 59/3, 35.1, 80, 59/83

(56) References Cited

U.S. PATENT DOCUMENTS

| | | | | |
|---|---|---|---|---|
| 473,139 A | | 4/1892 | Bernhardt | |
| 533,182 A | | 1/1895 | Strafford | |
| 1,458,294 A | | 6/1923 | Hook | |
| 2,050,253 A | | 8/1936 | Bager | |
| 3,690,369 A | * | 9/1972 | Wheeler | 59/35.1 |
| 4,651,517 A | | 3/1987 | Benhamou et al. | |
| 4,996,835 A | | 3/1991 | Rozenwasser | |
| D321,148 S | | 10/1991 | Chiaramonti et al. | |
| D340,422 S | | 10/1993 | Grando | |
| D343,136 S | | 1/1994 | Grando | |
| 5,285,625 A | | 2/1994 | Ofrat et al. | |
| D346,131 S | | 4/1994 | Chiaramonti et al. | |
| 5,309,704 A | * | 5/1994 | Grando | 59/35.1 |
| D362,203 S | | 9/1995 | Grando | |
| 5,452,572 A | * | 9/1995 | Alvaro et al. | 59/3 |
| D368,048 S | | 3/1996 | Rozenwasser | |
| D370,184 S | | 5/1996 | Rozenwasser | |
| D370,426 S | | 6/1996 | Rozenwasser | |
| 5,544,477 A | * | 8/1996 | Rozenwasser | 59/35.1 |
| D375,913 S | | 11/1996 | Rozenwasser | |
| 5,737,910 A | * | 4/1998 | Rozenwasser | 59/35.1 |
| 6,209,306 B1 | * | 4/2001 | Chia et al. | 59/80 |

FOREIGN PATENT DOCUMENTS

| | | | |
|---|---|---|---|
| EP | 0470937 | * | 7/1991 |

* cited by examiner

*Primary Examiner*—David Jones
(74) *Attorney, Agent, or Firm*—Levisohn, Lerner, Berger & Langsam, LLP

(57) ABSTRACT

A chain link for intertwining with other chain links to form a jewelry chain is machine formed by contouring the outer periphery of the link without any reduction in material volume while the link thickness is being compressed and reduced. The outer periphery is preferably machine contoured into an octagonal shape and the link is substantially flattened on all sides such that a cross-section taken through the contoured link is preferably substantially rectangular.

17 Claims, 6 Drawing Sheets

EXTERIOR SHAPED LINK AND METHOD

FIELD OF THE INVENTION

This invention relates to chain links in general, and more specifically to a chain link having a substantially rectangular cross section throughout and an outer periphery that is flattened and contoured through a die without any loss in chain link material.

BACKGROUND OF THE INVENTION

A jewelry "rope" chain is usually comprised of individual links intertwined to form a chain having the appearance of a double spiral or helix. Such individual links are usually termed "solid" or "hollow." With "solid" links, the thickness of the link defined between the inner and outer periphery is occupied by chain link material. With "hollow" links, the inner and outer periphery of the link is usually created by wrapping link material around a metal former and leaving a seam between the inner and outer peripheries through which the metal former is ultimately dissolved. Solid links require the use of more link material, which results in a heavier, sturdier and costlier chain. Hollow links require the use of less link material, thus resulting in a chain that is lighter and cheaper. However, both solid and hollow links may be constructed with identical outward appearances, such that jewelry rope chains formed by the intertwining of such links look identical.

The intertwining of chain links was originally accomplished by hand, with gaps facilitating the interengagement or intertwining of links to form a chain. Such intertwining of chain links to form a jewelry rope chain is also now accomplished by machine, in which case the creation, contouring, and intertwining of links to form a complete jewelry chain is achieved automatically with the aid of a machine. Thus, the rope chain art has evolved considerably since its inception from a hand-based art to a machine-based art, to the extent that a layman probably takes for granted the complicated and various methods used to create this highly decorative and ornamental piece of jewelry.

The appearance of individual links and the manner in which such links are intertwined to form a chain usually dictate the appearance of the resultant chain. There is a considerable body of prior art dedicated to chain links and jewelry rope chains formed by intertwining chain links having gaps. U.S. Pat. No. 4,651,517 to Benhamou et al. and U.S. Pat. No. 4,996,835 to Rosenwasser are a representative sampling.

There is also a considerable body of prior art dedicated to the contouring of such links and chains. For example, a link may be contoured by pounding as taught by U.S. Pat. No. 5,408,820 to Strobel, cutting as taught by U.S. Pat. No. 5,471,830 to Gonzales et al., U.S. Pat. No. 5,966,922 to Cossio and U.S. Pat. No. 5,285,625 to Ofrat et al., rolling as taught by U.S. Pat. No. 5,737,910 to Rosenwasser and stamping as taught by Rozenwasser in U.S. Pat. No. 5,544,477 (1-step stamping process) or by Grando in U.S. Pat. No. 5,309,704 (2-step stamping process). In each case, the contouring occurs through a complicated series of deformation steps or with a resultant loss of link material, particularly in accordance with traditional methods of diamond cutting, with increased manufacturing time and wasted material leading to reductions in the bottom line. With hollow links in particular, traditional contouring occurs through a direct deformation of the outer periphery by a deformation tool, instrument or the like.

The manner in which a hollow or solid chain link is contoured, and the manner in which a contoured chain link is assembled to form a jewelry chain has significant ornamental consequences. For instance, two chain links having similar overall profiles can be intertwined to form jewelry chains having significantly different outward appearances. U.S. Design Pat. Nos. 340,422 and 362,203, both to Grando, illustrate the intertwining of square links to form a rope chain having pointed spirals ('422 patent) and flattened spirals ('203 patent), the only difference between the respective chain links being the location of the gap. In the '422 patent, the gap is located at the junction of two sides, while in the '203 patent the gap is located in the middle of a side. Thus, even though two chains may comprise links of similar geometric configurations, regardless of whether such links are solid or hollow, minor differences between the constructions of such links, and the manner in which such links are assembled into a chain, may produce chains having drastically different appearances.

When contouring hollow or solid links and jewelry chains, it is most desirable to have faceted surfaces. Faceted surfaces reflect light at a variety of angles, giving the links and chain a sparkling, glittery appearance. Faceted surfaces also draw more attention than smooth, unfaceted surfaces, which translates into more praise and compliments related to the item of jewelry. Thus, any increase in aesthetic value is highly beneficial.

The chain link of the present invention is manufactured with a contoured, faceted appearance without sacrificing link material during an expeditious deforming process. Such link may be solid or hollow as desired. As discussed above, conventional means of creating facets on a solid link may result in the shaving or cutting of link material to create a flattened surface, which unnecessarily results in wasted link material. Other conventional means of creating facets on solid or hollow links may result in the deformation of the outer periphery of the link without removal of link material. However, such prior art methods are usually limited to the time-consuming application of a deformation tool having limited movement or deformation capabilities.

The contouring method of the present invention overcomes the deficiencies of the prior art by efficiently creating faceted hollow or solid links on a machine in a single step without any loss of link material and through the application of a pre-defined contouring mold or die. Thus, in a single maneuver, a conventional solid or hollow, annular chain link can be deformed into a faceted chain link for intertwining with other chain links to form a highly aesthetic jewelry chain or jewelry rope chain. Such deformation process can be applied to solid or hollow chain links as the case may be, with equally appealing results.

OBJECTS OF THE INVENTION

It is an object of the present invention, therefore, to provide a chain link for intertwining with other chain links to form a highly aesthetic jewelry chain.

It is a further object of the present invention to provide a chain link having a substantially rectangular cross section throughout.

It is a further object of the present invention to provide a chain link that is faceted with a machine in accordance with an uncomplicated, highly efficient deforming process.

It is a further object of the present invention to provide a process for deforming and contouring hollow or solid chain links using a minimal number of manufacturing steps.

It is a further object of the present invention to provide a process of faceting and contouring chain links through compression of said links.

It is a further object of the present invention to provide a process of deforming the outer periphery of chain links by conforming said outer periphery to a predetermined shape.

It is a further object of the present invention to provide a process of contouring the outer periphery of chain links by compressing said chain links within a die.

It is a further object of the present invention to provide a process of simultaneously deforming multiple sides of the outer periphery of a hollow or sold chain link.

Still other objects and advantages of the invention will become clear upon review of the following detailed description in conjunction with the appended drawings.

SUMMARY OF THE INVENTION

A chain link, for intertwining with other chain links to form a jewelry chain, is deformed on a machine by contouring the outer periphery of the link without any reduction in material volume while the link thickness is being compressed and reduced. The outer periphery is preferably contoured with flattened sides such that a cross-section taken through the contoured link is preferably substantially rectangular throughout. The link is preferably provided with a gap for intertwining links with other links, such link preferably being contoured such that the link gap is formed in the middle of a link side, and not at the junction of a pair of link sides, so that a resultant chain formed by the intertwining of such links has a unique, flattened appearance.

The contoured link of the invention is formed by flattening the sides of a chain link and causing the outer periphery of said link to conform to a predetermined shape without reducing the material volume of the link. Such contouring is achieved by using a die in conjunction with a machine that compresses such link, with the compression of the link causing the outer periphery of the link to expand and conform to the inner surface of the die. The deformation process can be applied to hollow or solid chain links with equally appealing results.

DETAILED DESCRIPTION OF THE PREFERRED EMBODIMENTS

Figure 1:
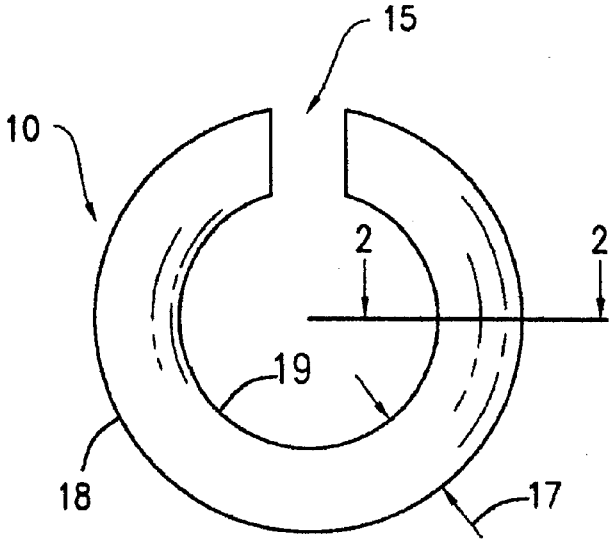
FIG. 1 is a front view of a conventional annular chain link.
Figure 2:
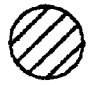
FIG. 2 is a cross section taken through line 2—2 in FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIGS. 1–6 illustrate one prior art process for transforming a chain link 10 (FIG. 1) having a gap 15 into a flattened link 12 (FIG. 6) for intertwining with other links to form a jewelry chain. It is well known in the jewelry art to hand-form link 10 by wrapping a wire (not shown) around a mandril (not shown) and then cutting such wire into individual links 10, with such gap 15 being formed from the cut resulting in the separation of the wire into individual links 10. Such annular link 10, as a result of being wrapped in a continuous spiral and then cut into individual links, will also have sides that are slightly askew or out of alignment. It is also well known in the jewelry art to machine-form links 10 by bending a wire (not shown) directly into an annular form. The resultant annular link 10, whether formed by hand or machine, will generally have a circular cross section (FIG. 2), which is also generally the cross-section of the original wire, a thickness 16 (FIG. 3), an outer periphery 18, an inner periphery 19 and a width 17 defined between said inner and outer peripheries.

Figure 3:
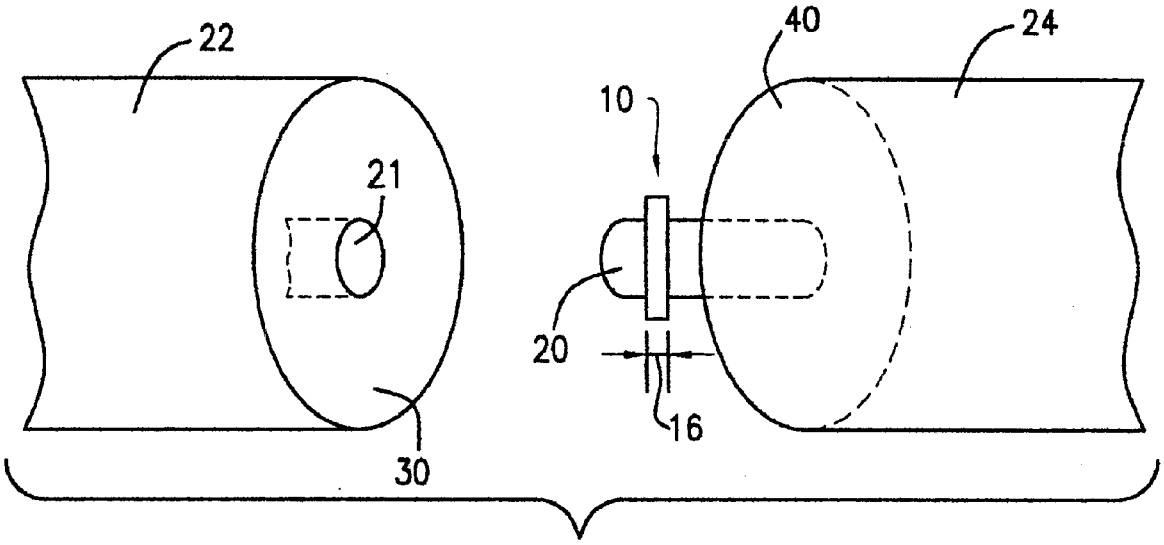
FIGS. 3 and 4 illustrate a prior art process of contouring the link of FIG. 1.
Figure 4:
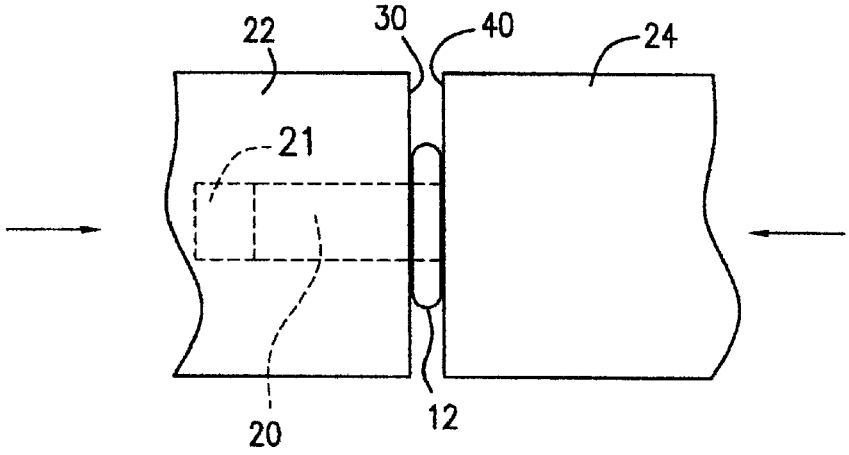
Figure 5:
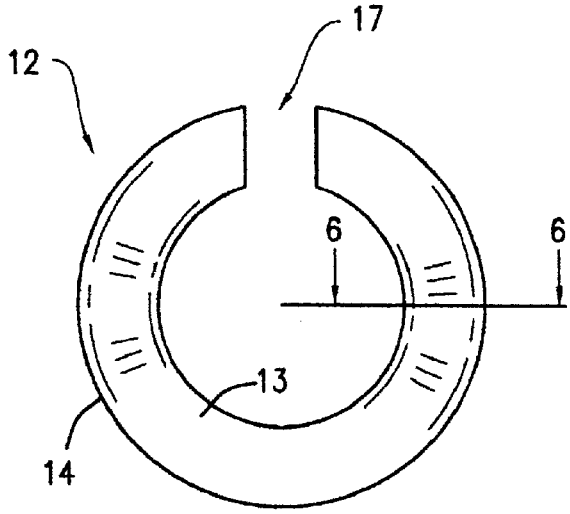
FIG. 5 is a front view of a link contoured in accordance with the process illustrated in FIGS. 3 and 4.
Figure 6:
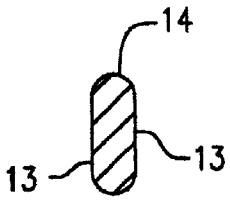
FIG. 6 is a cross section taken through line 6—6 in FIG. 5.

In accordance with such prior art process as shown in FIGS. 3–4, a machine comprising a first part 22 and a second part 24 having opposing wall surfaces 30, 40 is provided with an elongated support 20 on which is placed the annular link 10, with support 20 being adapted to be received in guide bore 21 when parts 22 and 24 are brought together. Link 10 is then compressed between the opposing wall surfaces 30, 40 of a compression machine 50 to a desired thickness, with the resultant link 12 having flattened sides 13 and a rounded outer edge periphery 14 (see FIGS. 5–6). The initial compression of the link 10 between parts 22 and 24 causes a straightening of the link sides, i.e., where the link sides are no longer askew if such link was hand-formed by winding on a mandril as described above, while the further compression causes a flattening of the sides 13 resulting in a simulative, faceted appearance. The rounded outer periphery 14 results from the unencumbered, outward expansion of link material along the outer periphery consistent with a volume reduction in link thickness. One machine known in the art that uses such a process is manufactured by FASTI, a well-known manufacturer in the art of chain-making.

When link 12 is intertwined with other links to form a jewelry chain, or more specifically a jewelry rope chain (not shown), such link being manufactured in accordance with the prior art process of FIGS. 3–4, the external surface formed along the chain will have a rounded surface resulting from the rounded outer peripheral edge 14 of the link opposite the gap 17. The flattened sides 13 attributed to the compression of the link 10 will provide a certain amount of luster. However, such flattened sides 13 are only present along the inside of the rope chain outer surface (not shown).

Thus, the outer peripheral edge, being rounded instead of flat, does not provide a faceted appearance along the outer spirals of the rope chain, which reduces the aesthetic appeal of such chain.

In accordance with the embodiments of the present invention, an annular link is compressed in a manner similar to that shown in the prior art above. However, such link is also further contoured to produce a faceted outer peripheral edge, which, when intertwined with similar links, results in a jewelry chain (see FIG. 15) having a faceted appearance along the courses or spirals of the chain. Such faceted appearance results from the intertwining of a link having substantially flattened sides, a substantially flattened outer periphery and a substantially rectangular cross section throughout said link. As discussed below, the substantially flattened sides, and even the substantially flattened outer periphery, may also have designs disposed thereon. Thus, such jewelry chain (see FIG. 15) has a greater number of facets, has a greater design appeal, and appears more lustrous than chains manufactured from links formed in accordance with prior art processes (see FIGS. 1–6).

Figure 7:
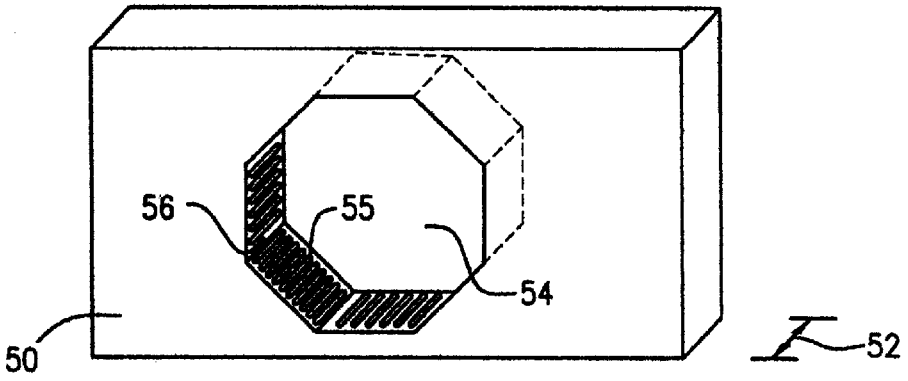
FIG. 7 is a shaping plate used with a contouring process of the present invention.
Figure 8:
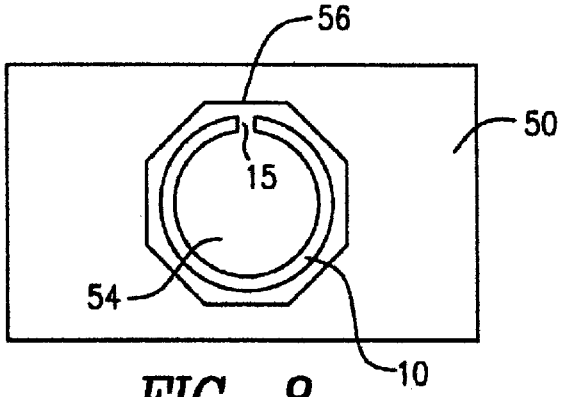
FIG. 8 illustrates the positioning of an uncontoured link within the shaping plate of FIG. 7.
Figure 9:
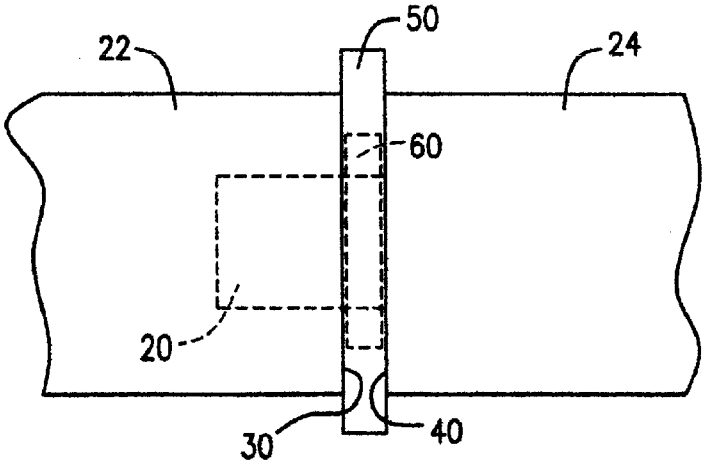
FIG. 9 illustrates the contouring of a link in accordance with one embodiment of a process of the present invention.
Figure 10:
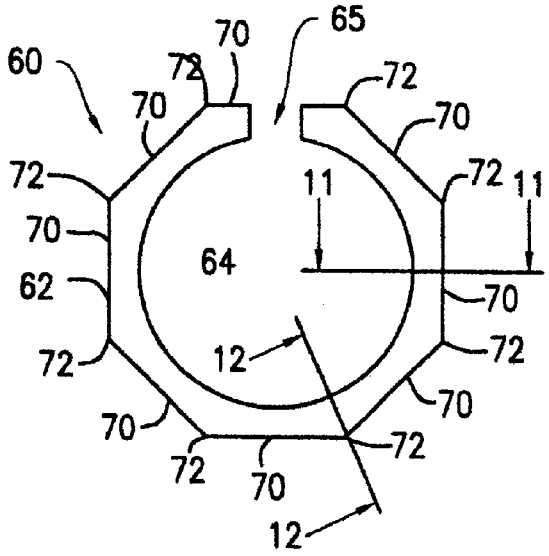
FIG. 10 is a front view of a link contoured in accordance with the process illustrated in FIG. 9.
Figure 11:
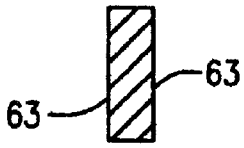
FIG. 11 is a cross section taken through line 11—11 in FIG. 10.
Figure 12:
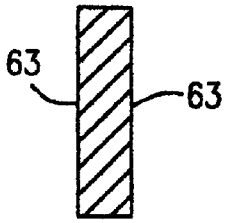
FIG. 12 is a cross section taken through line 12—12 in FIG. 10.

FIGS. 7–9 illustrate one embodiment of a process of the invention used to make one embodiment of a faceted chain link of the invention illustrated in FIGS. 10–12. As shown in FIGS. 7–9, a machine similar to the apparatus of FIG. 4, comprising a first part 22 and a second part 24 having opposing wall surfaces 30, 40 is provided with an elongated support 20 adapted for placement of an annular link 10 (FIG. 1) thereon. Prior to positioning on support 20, link 10 is initially positioned within an opening 54 of a shaping plate 50, said plate 50 having a thickness 52, and a shaping contour 56 (FIG. 8). The plate thickness 52 is preferably less than the thickness 16 of the uncontoured link 10, which is the wire diameter if the link 10 is of an annular construction. The link 10 and plate 50 are then placed on support 20 and such link 10 with plate 50 are compressed between opposing wall surfaces 30, 40. Such compression expeditiously results in a reduction in link thickness 16, which forces the outer periphery 18 to expand and conform to the contour 56 of the shaping plate 50. The shaping plate 50 may have a shaping contour 56 of any size, shape, thickness and uniformity. In this case, since the shaping contour 56 is octagonal and uniform, the resultant link 60 illustrated in FIGS. 9–12 will have an octagonal outer periphery 62 comprised of substantially the same length sides 70, while the inner periphery 64 retains the annular contour of the support 20. Of course, the shaping contour 56 may be other than octagonal or uniform as illustrated, although it will be preferable if the shaping contour 56 is polygonal and uniform such that the resultant link 60 has a uniform, flattened outer periphery 62. Also, since the link thickness 16 of the uncontoured link 10 is initially greater than the plate thickness 52, the opposing surfaces 30, 40 are able to contact and compress the sides of the link 10 to form flattened sides 63 on contoured link 60 as well.

Figure 16:
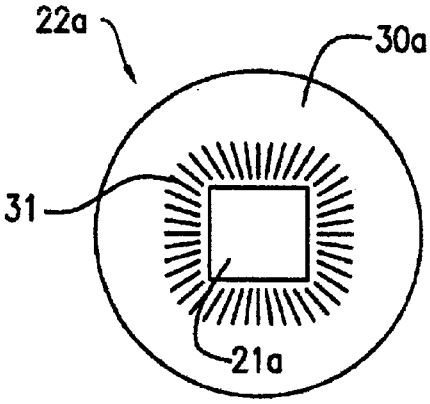
FIGS. 16 and 17 are front views of an alternative embodiment of opposing machine parts used to create a contoured chain link of the invention.
Figure 17:
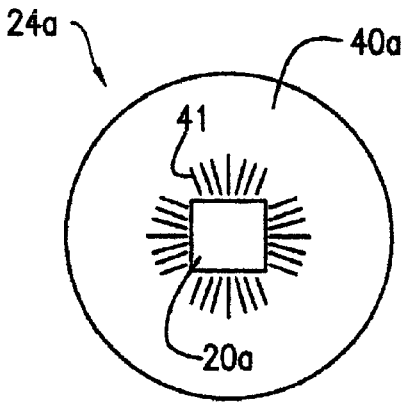

The process described in FIGS. 7–9 above results in a chain link (FIG. 10) having an octagonal outer periphery and a round inner periphery, other contouring arrangements will be possible. For example, as shown in FIGS. 16 and 17, members 22*a* and 24*a* might be provided with opposing wall surfaces 30*a*, 40*a* having contouring, representative designs 31, 41 embossed thereon, and a square-shaped support 20*a* provided on member 24*a* and corresponding guide bore 21*a* provided on member 22*a*. Upon compression of the opposing members 22*a* and 24*a* and corresponding surfaces 30*a* and 40*a* about an uncontoured chain link (see FIG. 1), designs 31, 41 would become deformed into the link side surfaces 63 (see FIGS. 11, 12) and the inner periphery 64 would be deformed (not specifically shown) according to the shape of the support 20*a*, or would be deformed into the shape of a square in the example shown in FIGS. 16 and 17. Designs 31, 41 provided on the opposing wall surfaces 31*a*, 41*a* could be outwardly extending or inwardly extending, in which case the side surfaces of the contoured link would be recess-deformed or groove-deformed respectively. Also, the designs 31, 41 as shown do not have to be uniform on both side surfaces of the resultant contoured link, or such surfaces 30*a*, 40*a* may be provided with one set of designs 31 or 41 as opposed to both sets of designs 31, 41. Furthermore, additional designs may be imparted to the outer periphery 62 of the chain link by including contouring means 55 of a similar nature on the shaping contour 56 of the shaping plate 50 (see FIG. 7). Again, such contouring means 55 may result in the imparting of recessed or grooved designs (not specifically shown) along the outer periphery 62 of the chain link due to the compression of link material into the contouring means 55, if such contouring means are recessed into the shaping contour 56, or the compression of link material around the contouring means 55, if such contouring means are outwardly grooved along the shaping contour 56. Contouring means 55 illustrated in FIG. 7 may be uniform or non-uniform along the shaping contour 56 in accordance with the design desired by the end user.

While FIGS. 7–9 illustrate the use of a separate shaping plate 50 insertable between opposing members 22 and 24, such plate 50 may be formed integral with either of members 22 or 24. Thus, for example, plate 50 may be attached to surface 30, 30*a* or 40, 40*a* or formed integral therewith. It would be preferable, however, if plate 50 were associated with surface 40, 40*a* since this would only necessitate the sliding of link 10 onto support 20, 20*a* which link would then be properly positioned within plate opening 54 during compression of said link 10.

In addition, it is preferable that uncontoured link 10 is positioned on support 20, 20*a* such that resultant gap 65 is located in the middle of an outer peripheral flattened side 70 and not at a point 72 defined between the joinder of such sides. This is achieved by positioning an uncontoured link 10 on support 20, 20*a* such that gap 15 (FIG. 8) is positioned adjacent the middle of a flattened surface on shaping contour 56. Also, the flattening of the sides 63 and outer periphery 62 of the contoured link 60 enables a chain formed by intertwining links 60 to appear lustrous and faceted. Such flattening also results in a rectangular cross-section along the flattened outer peripheral edges 70 (FIG. 11) and at the joinder 72 of such edges (FIG. 12), and if desired, such flattening may be accompanied by the impression of designs 31, 41, 55 into the sides and/or periphery of the chain link as described in connection with FIGS. 7, 16 and 17.

Figure 13:
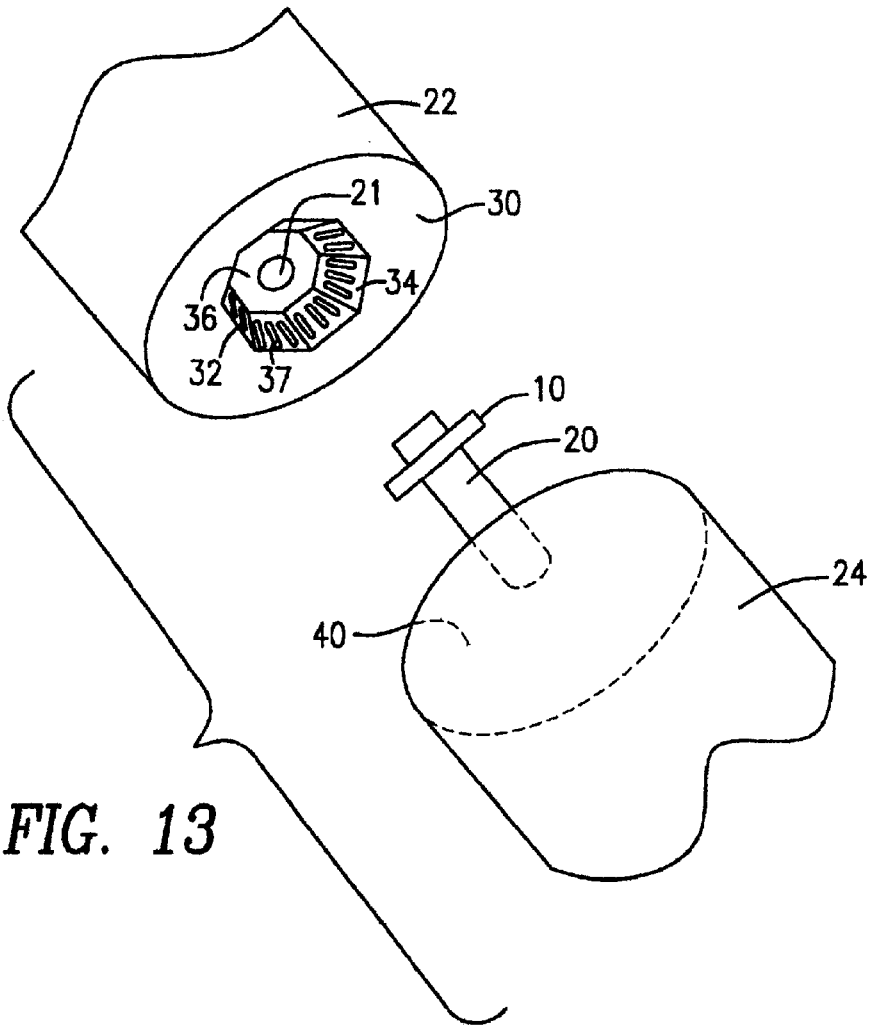
FIGS. 13 and 14 illustrate an alternative embodiment of a process of producing the contoured link of FIG. 10.
Figure 14:
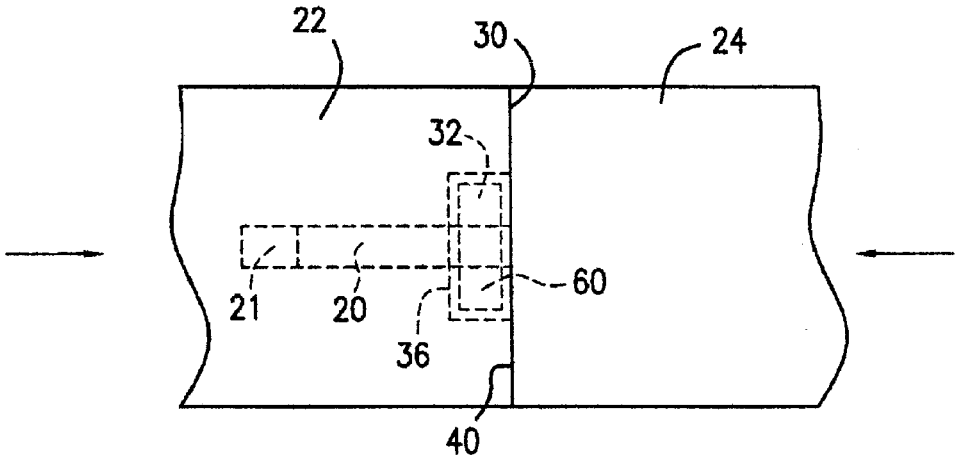

FIGS. 13–14 illustrate an alternative process for achieving the contoured link of the invention illustrated in FIGS. 10–12. Instead of using a shaping plate 50 as shown in FIGS. 7–9, compressive member 22 is provided with a contoured recess 32 having a shape to which the outer periphery of uncontoured link 10 is desired to conform. Such recess has a peripheral contour 34, a rear wall 36 and a guiding bore 21 adapted to receive and guide elongated support 20 during the compression of members 22 and 24. As discussed above with the thickness of plate 50, the thickness of uncontoured link 10 should be greater than the depth of the recess 32 so that the compression of walls 36 and 40 against link 10 (FIG. 14) simultaneously causes the link thickness 16 (see FIG. 3) to reduce and the outer periphery 18 to conform to the peripheral contour 34 of recess 32. Similarly to the process of imparting designs to the various surfaces of a contoured link as described in connection with FIGS. 7, 16 and 17, the peripheral contour 34 may be provided with contouring means 37 (FIG. 13) disposed around such contour 34 or at desired locations along such contour 34, to impart designs to the outer periphery of the contoured link. In addition, opposing surfaces 30, 40 may be provided with additional designs as shown on surfaces 30*a*, 40*a* in FIGS. 16 and 17 for purposes of imparting additional ornamentation to the side surfaces 63 (see FIGS. 11 and 12) of the contoured link. Again, such contouring means 37 (FIG. 13), 31, 41 (FIGS. 16, 17) may have any shape or design as desired by the user.

While FIGS. 13–14 illustrate the use of a contoured recess 32 within opposing member 22, such recess may instead be formed in member 24, so long as an uncontoured link 10 is compressed within the confines of a recess shaping contour 34. Also, while an octagonal recess contour 34 is illustrated, it will be understood that other contours may be used in accordance with the desires of the chain manufacturer. However, it is preferable that a polygonal contour be used in order to achieve a flattened outer periphery as illustrated, for example, with link 60 of FIG. 10.

Figure 15:
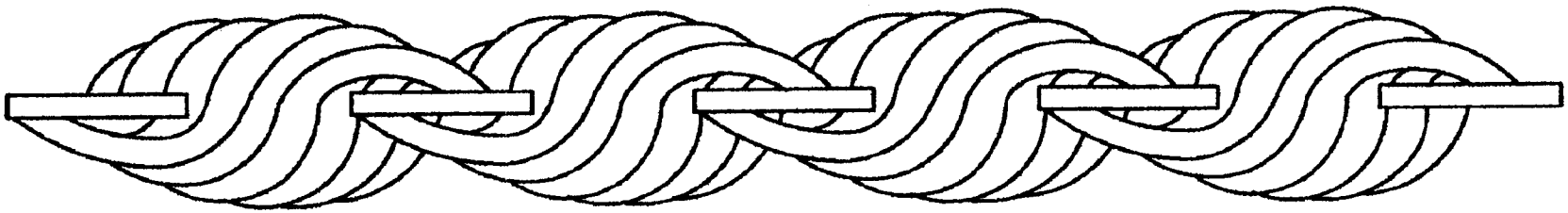
FIG. 15 illustrates a chain formed from chain links manufactured in accordance with the process of the invention.

FIG. 15 illustrates a chain 100 formed from links 60 that are contoured in accordance with the processes of the present invention. Such chain 100 has a unique, highly faceted appearance as a result of the flattened outer peripheral sides 70 and the compressed, flattened side surfaces 63. Such unique appearance also results from the preferable positioning of the gap 65 opposite a flattened outer peripheral side surface 70 and not a junction point 72. While such chain 100 is illustrated as a jewelry "rope" chain, other chains may be manufactured from links contoured in accordance with the processes of the present invention.

A chain link formed in accordance with the methods of the present invention may initially have any inner or outer peripheral contour, and may be of either a hollow or solid cross section. It is preferable that the inner periphery of the uncontoured link be dimensioned for engagement with the elongated support, so that the uncontoured link can be properly supported during compression and contouring. In almost all cases, the contoured link will have an outer periphery that is different from the inner periphery, although in some cases the inner and outer peripheries of the contoured link will be the same. In all instances, however, the contouring of a chain link will not reduce the material volume of the link, since such link material is merely redistributed through the compression and contouring process so that the outer periphery of the uncontoured link conforms to a predetermined shape or contour. In addition, the contouring and possible designs imparted to the surfaces of the link during such contouring should not alter the substantially rectangular cross section present throughout the link.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of forming a shaped chain link suitable for intertwining with other shaped chain links to form a jewelry chain, said method comprising the steps of:

providing a chain link having top, bottom and a pair of side surfaces and a thickness between said pair of said surfaces, said chain link having, when viewed toward said side surface, an inner periphery, an outer periphery and a width defined between said inner and outer peripheries, placing said chain link on an elongated support having an end wall and a support surface accommodating the shape of the inner periphery of said chain link, advancing said elongated support toward a die having an end wall and a guiding bore extending therethrough, said guiding bore adapted to receive and guide said elongated support, compressing said chain link between said end wall of said elongated support and said end wall of said die such that said thickness of said chain link is reduced, and altering said outer periphery of said chain link during said compressing step without reducing said materiel volume, to form a contoured outer periphery.

2. A method in accordance with claim 1, wherein said altering step further comprises positioning a shaping plate between said end wall of said elongated support and said end wall of said die, said shaping plate having a contour to which said outer periphery of said chain link conforms during the compressing of said chain link between said end walls.

3. A method in accordance with claim 2, wherein said reshaping plate further comprises a polygonal contour.

4. A method in accordance with claim 2, wherein said reshaping plate further comprises a octagonal contour.

5. A method in accordance with claim 1, wherein said altering of said outer periphery further comprises providing a contouring bore positioned around said guiding bore and said end wall of said die, said contouring bore having a contour to which said outer periphery of said chain link conforms during the compressing of said chain link between said end walls of said die and said elongated support.

6. A method in accordance with claim 5, wherein said reshaping plate further comprises a polygonal contour.

7. A method in accordance with claim 6, wherein said reshaping plate further comprises a octagonal contour.

8. A method in accordance with claim 3, wherein said contoured outer periphery of said chain link is defined by a plurality of sides having individually discernible lengths and junction points at the junctions of such sides, and a gap defined along a length of one of said plurality of sides and not at a junction point defined between such sides.

9. A method in accordance with claim 5, wherein said contoured outer periphery of said chain link is defined by a plurality of sides having individually discernible lengths and junction points at the junctions of such sides, and a gap is defined along a length of one of said plurality of sides and not at a junction point defined between such sides.

10. A method in accordance with claim 1, wherein during said compressing and altering steps said thickness of said chain link expands along portions of the said chain link.

11. A method in accordance with claim 1, further comprising the step of forming a separate design in the outer periphery of said link.

12. A method in accordance with claim 11, wherein said end wall of said elongated support or said end wall of said die is further provided with design means for imparting a separate design in the outer periphery of said link during said compressing and altering steps.

13. A method in accordance with claim 5, further comprising the step of forming a separate design in the outer periphery of said link.

14. A method in accordance with claim 13, wherein said contour of said contouring bore further comprises design means for imparting a separate design to the outer periphery of said link during said compressing and altering steps.

15. A method of forming a shaped chain link suitable for intertwining with other shaped chain links to form a jewelry chain, said method comprising the steps of:

providing a chain link having top, bottom and a pair of side surfaces and a thickness between said pair of said surfaces, said chain link having, when viewed toward said side surface, an inner periphery, an outer periphery and a width defined between said inner and outer peripheries, placing said chain link on an elongated support having an end wall and a support surface, advancing said elongated support toward a die having an end wall and a guiding bore extending therethrough, said guiding bore adapted to receive and guide said elongated support, end compressing said chain link between said end wall of said elongated support and said end wall of said die and conforming said outer periphery of said chain link to a predetermined contour.

16. A method in accordance with claim 15, wherein said predetermined contour is an octagonal contour.

17. A method in accordance with claim 15, wherein said cross section is substantially rectangular.

* * * * *